US006968585B2

(12) United States Patent
Shaw

(10) Patent No.: US 6,968,585 B2
(45) Date of Patent: Nov. 29, 2005

(54) ANTIDECUBITUS HEEL PAD

(76) Inventor: Mark Shaw, 1175 E. Calla Rd., Apt. B204, Poland, OH (US) 44514

( * ) Notice: Subject to any disclaimer, the term of this patent is extended or adjusted under 35 U.S.C. 154(b) by 0 days.

(21) Appl. No.: 10/667,791

(22) Filed: Sep. 22, 2003

(65) Prior Publication Data

US 2005/0060808 A1 Mar. 24, 2005

(51) Int. Cl.[7] ..... A47C 20/02; A47C 20/04
(52) U.S. Cl. ..... 5/648; 5/655.9; 5/953
(58) Field of Search ..... 5/630, 636, 648–651, 5/652, 655.9, 638, 641, 646, 653, 656, 953; 297/423.11, 423.17, 423.39, 423.4, 423.41

(56) References Cited

U.S. PATENT DOCUMENTS

| | | | | | |
|---|---|---|---|---|---|
| 3,403,414 | A | * | 5/1968 | Unger | 5/636 |
| 3,638,255 | A | * | 2/1972 | Sterrett | 5/641 |
| 4,099,278 | A | * | 7/1978 | Parisi | 5/655.9 |
| 4,118,813 | A | * | 10/1978 | Armstrong | 5/638 |
| 4,190,697 | A | * | 2/1980 | Ahrens | 428/217 |
| 4,777,855 | A | * | 10/1988 | Cohen | 5/636 |
| 4,843,666 | A | | 7/1989 | Elesh et al. | |
| D311,295 | S | | 10/1990 | Roberts | |
| 5,031,261 | A | | 7/1991 | Fenner, Sr. | |
| 5,054,144 | A | * | 10/1991 | Stuart et al. | 5/648 |
| 5,107,558 | A | | 4/1992 | Luck | |
| 5,117,519 | A | | 6/1992 | Thomas | |
| 5,121,515 | A | * | 6/1992 | Hudson | 5/636 |
| 5,136,741 | A | | 8/1992 | Balonick et al. | |
| 5,398,354 | A | | 3/1995 | Balonick et al. | |
| 5,430,901 | A | | 7/1995 | Farley | |
| 5,638,564 | A | * | 6/1997 | Greenawalt et al. | 5/636 |
| 5,802,646 | A | | 9/1998 | Stolpmann et al. | |
| 5,815,865 | A | | 10/1998 | Washburn et al. | |
| 6,175,980 | B1 | * | 1/2001 | Gaither | 5/654 |
| 6,260,221 | B1 | | 7/2001 | Grabell et al. | |
| 6,371,894 | B1 | * | 4/2002 | Hill | 482/121 |
| 6,378,152 | B1 | | 4/2002 | Washburn et al. | |
| 6,634,045 | B1 | * | 10/2003 | DuDonis et al. | 5/648 |
| 6,694,553 | B1 | * | 2/2004 | Yates | 5/646 |
| 2004/0107501 | A1 | * | 6/2004 | Kancilja et al. | 5/636 |

* cited by examiner

*Primary Examiner*—Michael Safavi
(74) *Attorney, Agent, or Firm*—Renner, Kenner, Greive, Bobak, Taylor & Weber

(57) ABSTRACT

The present invention provides a heel pad for reducing the likelihood of decubitus ulcers on a patient's heels when the patient is lying on a mattress, the heel pad including, a cushion adapted to rest on the mattress beneath the calves of the patient, wherein the cushion has a front, a rear, a top, a bottom and a pair of ends, the cushion including a core layer having an arched profile, wherein the core tapers downward toward the front and the rear, and a top layer covering the core layer, the top layer being softer than the core layer, and thicker toward the front and rear edges, wherein the top of the cushion tapers downwardly toward the rear.

24 Claims, 2 Drawing Sheets

ANTIDECUBITUS HEEL PAD

TECHNICAL FIELD

The present invention generally relates to the treatment of decubitus ulcers and the general improvement of patient comfort and treatment. In particular, the present invention relates to a heel pad designed to reduce the likelihood and spread of decubitus ulcers. Most particularly, the present invention relates to a heel pad having a core and a softer top layer, where the pad is profiled to cantilever a patient's heels to prevent decubitus ulcers.

BACKGROUND OF THE INVENTION

Decubitus ulcers commonly afflict bedridden patients. They are caused by squeezing of the patient's soft tissue between bony prominent of the patient's skeleton and the surface on which the patient is supported robbing the skin of its blood supply. One common location for the formation of such ulcers is in the area of the patient's heel. Here, the soft tissue surrounding the patient's heel is squeezed reducing blood flow and the attendant supply of oxygen to that tissue. Constant pressure in this area for a significant period of time starves the tissue of oxygen resulting in necrosis and the development of decubitus ulcers. While a patient is bedridden, the heel bears a great deal of the patient's weight making heel decubitus ulcers more prevalent than others. Heel ulcers may account for up to 30% of all ulcers found in hospital patients.

These ulcers, while not directly related to the patient's condition, may extend the patient's stay in the hospital increasing cost to the patient or his or her insurance carrier, and reducing available bed space for other patients. More importantly, due to their nature, these ulcers are more difficult to heal causing extended discomfort for the patient and increasing the chance for infection. In severe cases, such infection may require amputation of the infected limb. Attempts have been made to reduce the likelihood of such ulcers. These attempts have generally focused on the placement of cushioning material beneath the patient's heel. For example, U.S. Pat. No. 5,398,354 discloses a heel pillow that is generally rectangular in shape and includes a lower portion that is essentially a tray constructed of foam material having a cavity in which a pillow is received. A top section including a rectangular foam pad that covers the entire tray portion and a cover that is water impervious fits over the pad and partially over the lower assembly. In this invention, the heel rests on the pillow portion to cradle the heel in the softer pillow portion for increased cushioning effect. As will be appreciated, despite the increase cushioning effect, the heels still carry the weight of the patient's legs, and the soft tissue of the heel is still trapped between the bone and a supporting surface. Moreover, the cushion raises the patient's heels reducing blood flow thereto. Consequently, decubitus ulcers may still form on the patient's heel.

SUMMARY OF THE INVENTION

It is, therefore, an object of the present invention to provide an improved heel pad designed to reduce the likelihood of decubitus ulcers.

It is another object of the present invention to offload pressure on the patient's heels with minimal elevation.

In light of at least one of the foregoing objects of the present invention provides a heel pad for reducing the likelihood of decubitus ulcers on a patient's heels when the patient is lying on a mattress, the heel pad including, a cushion adapted to rest on the mattress beneath the calves of the patient, wherein the cushion has a front, a rear, a top, a bottom and a pair of ends, the cushion including a core layer having an arched profile, wherein the core tapers downward toward the front and the rear, and wherein the top of the cushion tapers downwardly toward the rear, a top layer covering the core layer, the top layer being softer than the core layer, and thicker toward the front and rear edges.

The present invention further provides a method of reducing the likelihood of decubitus heel ulcers including, providing a cushion having a front, a rear, a top and a bottom, where the cushion includes a core layer and an outer layer, where the outer layer is softer than the core layer, inserting the pad beneath the calves of the patient and cantilevering the heels of the patient over the end of the pad.

The present invention further provides a heel pad including, a cushion having a core layer and an outer layer, the outer layer being softer than the core layer, wherein the core layer has a front edge, a rear edge, and a top surface spanning the edges, the top surface defining a semi-circular arch, wherein the arch has a centrally located apex adapted to reside beneath the patient's calves, wherein the outer layer covers the core and has a thickness that is substantially inversely related to a thickness of the core layer, wherein front and rear edges of the outer layer curve downwardly from the top surface to define a clearance between the cushion and the heels and knees of the patient, an at least fluid resistant cover surrounding the cushion and including a base residing beneath the cushion, a pair of flaps extending downwardly from the base, wherein the flaps are adapted to fit around the mattress.

DETAILED DESCRIPTION OF THE INVENTION

Figure 1:
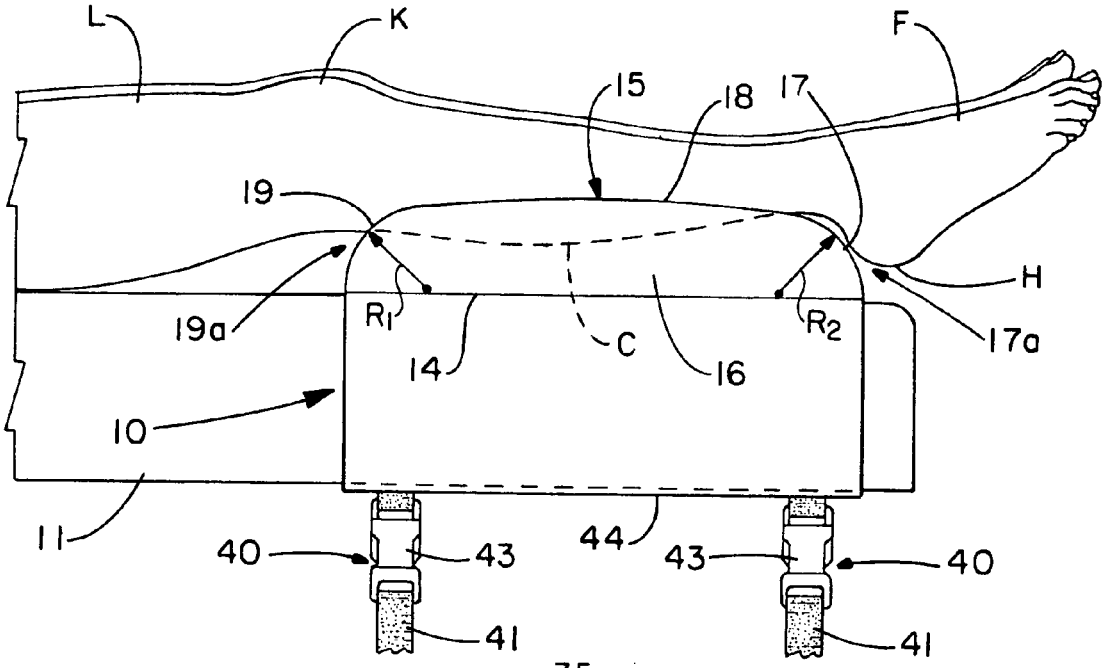
FIG. 1 is a side elevational view of a heel pad according to the concepts of the present invention attached to a mattress and shown supporting the legs of the patient without excessive pressure.

An antidecubitus heel pad according to the concepts of the present invention is shown in the drawings and generally indicated by the numeral 10. Heel pad 10 may be used in conjunction with a mattress 11, which may be set on a frame 12, or other patient supporting structure. The heel pad 10 generally includes a cushion, generally indicated by the numeral 15 that is placed beneath the patient's calves C to take pressure, from the mattress 11 or other surface, off of the patient's heels H. Cushion 15 may be any cushioning material including foam, cotton, or inflatable bladders. In the example depicted in the drawings, a multilayered pad constructed of foam is used to provide a soft surface upon which the patient's calves C may rest. The cushion 15 generally has a base 14, a rear edge 17 and forward edge 19 extending upward from the base 14, a pair of ends 16 extending upward from the base 14, and a top surface connecting the ends 16 and edges 17, 19 opposite the base 14.

Figure 2:
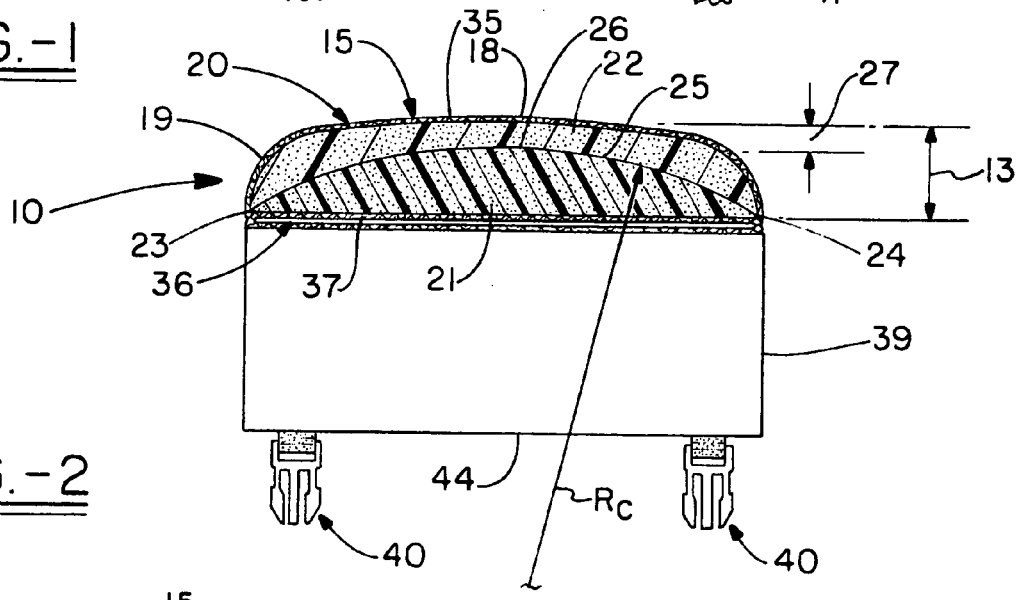
FIG. 2 is a side elevational view of a heel pad according to the concepts of the present invention partially sectioned to show details of the pad structure including a cushion having a top layer, a core layer, and a cover that surrounds the layers and defines a pocket beneath the core.

As best shown in FIG. 2, cushion 15 may have a profile 20, where the cushion 15 tapers away from the patient's heel H. It will be appreciated that a number of shapes may be used to accomplish this. For example, as depicted in the Figures the rearward edge 17 of cushion 15 may round downward away from the top surface 18 of the cushion 15. In this way, the patient's calves C rest on the top surface 18 of the cushion 15 and the heel H maybe cantilevered above the supporting surface of the bed 11. As depicted, for example, in FIG. 1, a clearance 17*a* may be defined between the patient's heel H and the heel pad 10. In this way, the soft tissue surrounding the bony prominent (calcaneus) of the heel H is not compressed between the bone and supporting surface. Instead, the more muscular and better vascularized calf C of the patient's leg is used to elevate the heel H above the supporting surface. In this way, the more capable portion of the patient's legs L is used to support their weight on the mattress 11 reducing the likelihood of decubitus ulcers.

It will be appreciated that since the calves C carry the weight of the patent's legs L, some contact between the heel H and a supporting surface, such as, the heel pad 10 or mattress 11, may occur without creating sufficient pressure to form decubitus ulcers. Rounding the rear edge 17 of pad 10 away from the heels H helps to avoid contact with the heels H, and, when contact occurs, reduces the pressure on the heels H. The rear edge 17 of pad 10 may have a constant radius to give the rear edge 17 of pad 10 a near anatomical shape corresponding to the radius formed above the heel H. In this way, any pressure from the heel H contacting pad 10 is spread evenly across the heel H and the surrounding tissue.

The cushion 15 may also extend downward at its forward edge 19. For example, the forward edge 19 may round downward away from the top surface 18 to form a second clearance 19*a* between the patient's knee K and the cushion 15. The posterior tibial artery runs along the backside of the knee K. Since there is very little tissue on the back of the knee K, pressure against this area compresses the tibial artery impinging blood flow to the calf C and heel H. By providing a clearance at 19*a*, the cushion 15 may be better isolated on the calf C of the patient's leg avoiding pressure against the underside of the knee K that might reduce blood flow to the patient's calf and heel C, H. As in the case of the heel H, some pressure against the knee K is permissible. To spread the pressure evenly, the radius of the pad 10 at forward edge 19 may be constant and conform to the radius between the knee K and calf C. In the example shown, a radius of about one inch was found suitable for both edges 17,19. This radius is provided for purposes of example but is not to be considered limiting. It will further be understood that the radiuses R1,R2 respectively at each edge 19,17 may be different.

To further reduce the likelihood of impingement of the blood flow, the cushion 15 may be constructed of multiple layers, as shown. In the example depicted in FIG. 2, two layers are used, namely, a core layer 21 and a top layer 22 that covers the core layer 21. In the preferred embodiment, the core layer 21 is harder than the top layer 22. If the top layer 22 contacts the patient's heels H or knees K, the softness of the top layer 22 prevents it from exerting too much pressure on the patient's heels H or knees K. Also, the softer top layer 22 provides little resistance to the weight of the patient's legs L allowing them to sink into the top layer 22, such that the top layer 22 envelopes the calves C distributing the weight of the leg L and reducing pressure on the calf C. In particular, as the calves C sink into the top layer 22, the top layer 22 envelopes the calves C to spread pressure evenly about a large portion of the calves' circumference. Consequently, as shown schematically in FIG. 1, the top layer 22 gives way to the weight of the patient's legs L, causing the core layer 21 to support most of their weight. Again, this ensures that the greatest amount of pressure is applied at the calf C, which is capable of receiving the pressure without any degradation in the blood flow. Also, the softer top layer 22 envelopes the calves C spreading the pressure over the surface of the calves C, to avoid formation of small pressure points. This also reduces the likelihood that blood flow would be impinged and improves patient comfort.

The top 25 of core layer 21 may be given an arched profile, for example, semicircular, have a radius Rc of about 4 inches to about 8 inches including a radius Rc of about 7 inches as shown in the depicted example. This range has been found suitable for the depicted pad, but it will be appreciated that the radius Rc may fall outside of this range as the proportions of the pad change. The apex 26, or highest point, on the core layer 21 is located between the knee K and heel H and may be centered between the heel H and knee K as in the arched core layer 21 shown. With the apex 26 centered, the heel pad 10 is reversible and makes it easier for hospital personnel to properly locate the pad 10 relative to the patient's knees K and heels H. For example, by centering the pad 10 beneath the patient's calves C, the apex 26 of the core layer 21 is located beneath the calves C.

The arched profile of the core layer 21 has a greatly reduced thickness at its forward and rear edges 23, 24, such that, if contact is made with the pad 10 by the knee K, it will be made with the softer top layer 22 reducing the likelihood that the tibial artery would be compressed. Also, the profile of the core layer 21 and the pad 10 encourages the patient's feet F to rest in a supinated position, as shown in FIG. 1. As will be appreciated, this position benefits blood flow.

Some patients may have difficultly with arterial or venous blood flow to the legs L. An arterial condition is indicated by reduced blood flow to the legs L and feet F. To off load the heel H without an elevation that would unduly impede arterial flow, the pad 10 may be given a low profile or be inclined downward toward the rear 17 to lower the patient's legs L and feet F. The amount of downward inclination and reduction in the thickness 13 of the pad 10 may be limited by the clearance between the patient's heels H and the mattress 11. If the pad 10 is too thin, the patient's weight will fall on the heels H negating the benefits of the pad 10. In practicing this aspect of the invention, the cushion 15 may have a thickness of about 1 to about 4 inches. In the example shown, the cushion 15 is about 2 inches thick. This thickness is provided as an example and is not intended to be limiting. In a cushion 15 having multiple layers, as depicted in the Figures, the layers contribute to the elevation of the patient's heels H in terms of their resistance to the weight of the patient's legs L. For example, in the two layer example shown, the top layer 22 is softer than the core layer 21. In this way, the patient's calves C sink into the top layer lowering the height of the patient's heels H relative to the mattress 11. Thus, the top layer 22 may generally provide very little resistance to the weight of the patient's legs L. For example, the top layer 22 may have a thickness 27 of approximately one half of the total thickness 13 of the cushion 15 and be constructed of a visco-elastic foam having a density of about 1.5 lbs./ft.$^3$. In this example, the core layer 21 may have a density of about 3.5 lbs./ft.$^3$ with an indentation lead deflection (ILD) in the mid thirties, for example about 33.

Figure 3:
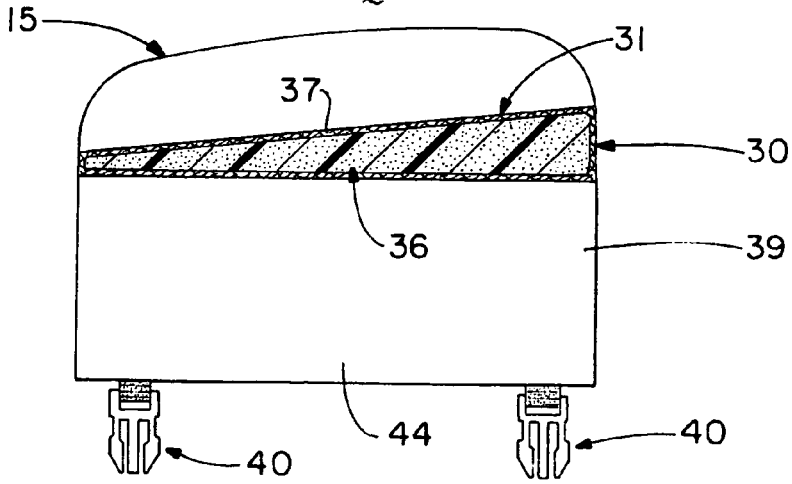
FIG. 3 is a side elevational view similar to FIG. 2 shown with an inclined pad inserted within a pocket.
Figure 4:
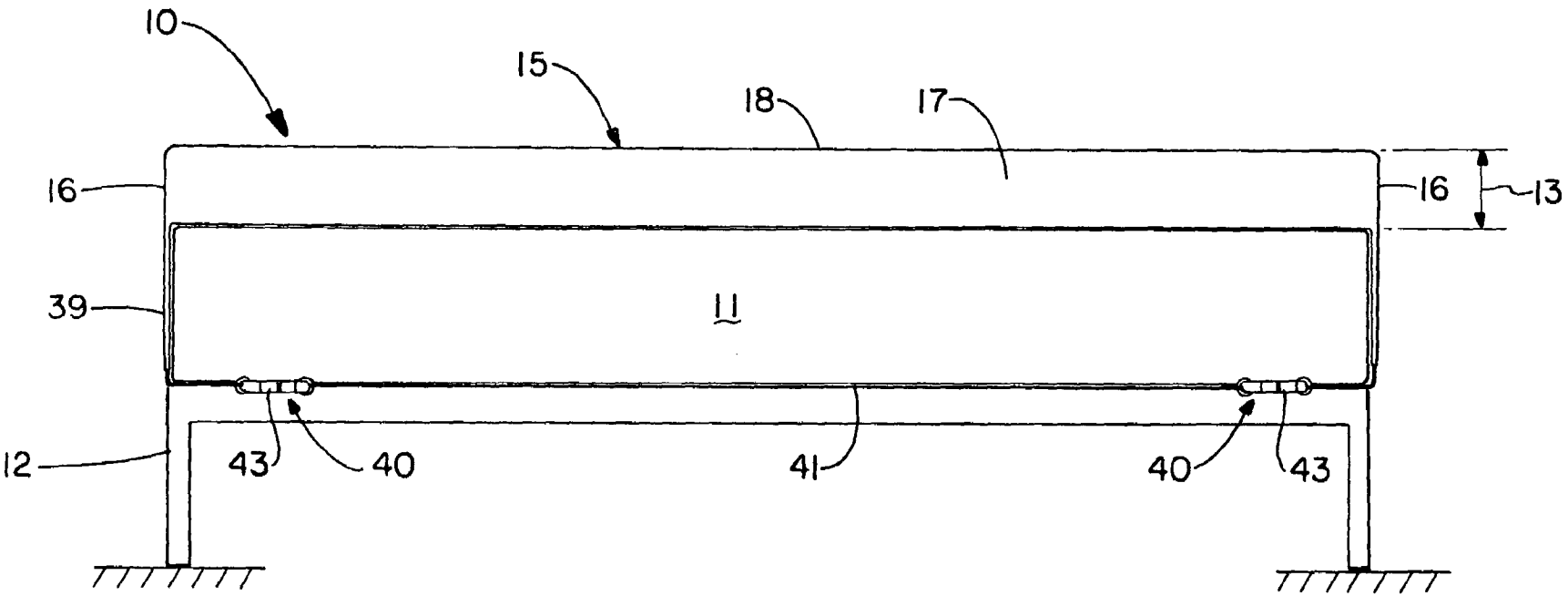
FIG. 4 is a rear elevational view of a pad according to the concepts of the present invention shown attached to a mattress by flaps extending downwardly from the pad cover and a pair of straps that extend beneath the mattress and attach to each of the flaps.

In a venous condition, the patient has difficulty with blood flow back to the heart from the legs L. To cope with this condition, the rearward end 17 of pad 15 may be raised, for example by placing a riser, generally indicated at 30, beneath pad 15. For example, wedge-shaped riser 30 that is inclined upward toward the rear 17 of cushion 15 may be inserted beneath the core layer 21 to raise the patient's feet F. The riser 30 may have a triangular section with an upwardly sloped top surface 31, as shown in FIG. 3. In this example, the steady incline of riser 30 avoids creation of undesirable pressure points beneath pad 15 that may be transmitted to the patient. While the riser 30 may be attached or integrally formed with the pad 15, it is desirable to use a removable riser 30 to provide greater flexibility in using the heel pad 10 with multiple patients' conditions. Since the riser 30 may be removed, a water impervious surface or enclosure may encompass riser 30 to protect it from fluids. For example, the riser 30 may be placed in a sealed plastic bag.

Similarly, it is desirable to protect the cushion 15 from fluids. To that end, a fluid resistant or impervious cover, generally indicated at 35 may envelope the cushion 15. Since the cushion 15 may be used with a removable riser 30, the cover 35 may be provided with a pocket 36 into which the removable riser 30 may be inserted. In the example shown, the pocket 36 is formed directly below the cushion 15 and separated from the cushion 15 by a layer of fabric 37 extending between the base 14 of cushion 15 and the top 34 of riser 30. This layer of fabric 37 may be constructed of the same material as cover 35. As will be appreciated, the pocket 36 may be sized and shaped to receive a given riser 30. For example, as best shown in FIG. 3, the pocket 36 may have a generally triangular section for receiving a triangular riser 30.

To help protect the underlying mattress 11, the heel pad 10 may further include flaps 39 that extend downwardly from the cover 35. As best shown in FIG. 1, the flaps 39 cover a portion of the side of the mattress 11 protecting the mattress and making it easier to place sheets on the mattress 11. To close the pocket 36, flaps 39 may attach above the pocket 36 and, thus, cover the pocket 36 when they hang down.

To help locate the heel pad 10 and prevent the pad 10 from being dislodged during movement of the patient, a securement assembly, generally indicated by the numeral 40, is provided. Securement assembly 40 generally attaches the heel pad 10 to the mattress 11 or other supporting structure, such as the bed frame 12, to prevent it from sliding or otherwise being dislodged. To that end, it will be appreciated that a number of structures may be used for this purpose including a strap 41 as depicted in the Figures. Strap 41 is sized such that it will fit around the mattress 11 attaching the heel pad 10 thereto. Alternatively, strap 41 may be wrapped around a portion of the bed frame 12 to hold heel pad 10 in place. Strap 41 may be made of an elastic material to facilitate attachment and to ensure that the heel pad 10 is snugly fit against the mattress 11. In the example shown, a pair of adjustable non-elastic straps 41 attach to quick connectors 43 extending from the bottom end 44 of the flap 39. As will appreciated, the quick connectors 43 may be of a number of forms available in the art including the plug and socket type shown. The quick connect fasteners 43 provide an efficient means of removing the heel pad 10 from the mattress 11. Employing quick connectors 43 at either side of the heel pad 10 allows the straps 41 to remain even though the heel pad 10 has been removed. Otherwise, straps 41 may be connected directly to the heel pad 10, as by sewing or other fastening means.

In use, the heel pad 10 is placed on the mattress 11 and located between the heel H and knee K of the patient such that the cushion 15 contacts the patient's calves C. The heel pad 10 may then be secured, as by straps 41 to maintain the proper position relative to the patient's legs. For patients with a venous condition, the heels H may be raised by inserting riser 30 beneath the cushion 15 to incline the cushion upwardly toward its rear 17. As depicted in the example shown in FIG. 3, an inclined triangular sectioned riser 30 may be inserted into a similarly sectioned pocket 36 formed in the heel pad cover 35 to raise the rear 17 of cushion 15.

For an arterial condition, the additional riser 30 may be removed and the cushion 15 returned to a generally horizontal position. To further aid with this condition, the cushion 15 may have a very low profile or taper downwardly toward the rear 17 to lower the heel H of the patient yet still off load pressure from the heel H by supporting the legs L at the calves C. In this way the soft tissue of the heel H is not compressed, and adequate blood supply reaches the heels H preventing the formation of decubitus ulcers. The cantilevered arrangement ensures that the heel H does not bear any significant weight that could lead to a loss of circulation. Also, allowing the legs L to sink into a soft top layer 22 lowers the heels H further improving circulation.

In light of the foregoing, it should thus be evident that an antidecubitus heel pad, according to the concepts of the present invention, substantially improves the art. While, in accordance with the patent statutes, only the preferred embodiment of the present invention has been described in detail hereinabove, the present invention is not to be limited thereto or thereby. It will be appreciated that various modifications may be made to the above-described embodiment without departing from the spirit of the invention. Therefore, to appreciate the scope of the invention, reference should be made to the following claims.

What is claimed is:

1. A heel pad for reducing the likelihood of decubitus ulcers on a patient's heels when the patient is lying on a mattress, the heel pad comprising:

a cushion adapted to rest on the mattress beneath the calves of the patient;

wherein said cushion has a front, a rear, a top, a bottom and a pair of ends, said cushion including a core layer having an arched profile, wherein said core tapers downward toward said front and said rear;

a top layer covering said core layer, said top layer being softer than said core layer, and thicker toward the front and rear edges, wherein said top layer of said cushion tapers downwardly toward said rear;

a cover constructed of fluid resistant material in which said cushion is received; and wherein said cover includes a pocket having at least one open end formed beneath said cushion and separated therefrom by a layer of cover material; and a riser insertable within said pocket to raise a portion of said cushion.

2. The heel pad of claim 1, wherein said riser is triangular in shape and has an inclined surface that extends from the front of said cushion upwardly to the rear of said cushion.

3. The heel pad of claim 2, wherein said pocket has a triangular section that conforms to the triangular section of said riser.

4. The heel pad of claim 1, wherein said cover has a flap attached at either end, said flaps extending downwardly from a base of said cover; and a strap extending between said flaps adapted to secure said cushion beneath the calves of the patient.

5. The heel pad of claim 4 further comprising a quick connector attached to said flap and extending downwardly for attachment of said strap to said flaps.

6. The heel pad of claim 4, wherein said flaps extend a selected length for covering the sides of the mattress.

7. The heel pad of claim 1, wherein said core layer has an apex located centrally relative to the front and rear of said cushion.

8. The heel pad of claim 1, wherein said top layer has front and rear edges that round downwardly to conform respectively to the knee and heel of the patient.

9. The heel pad of claim 8, wherein said front and rear edges of said top layer round downwardly in a symmetrical fashion and have a radius of about one inch.

10. A heel pad for reducing the likelihood of decubitus ulcers on a patient's heels when the patient is lying on a mattress, the heel pad comprising:

a cushion adapted to rest on the mattress beneath the calves of the patient;

wherein said cushion has a front, a rear, a top, a bottom and a pair of ends, said cushion including a core layer having an arched profile, wherein said core tapers downward toward said front and said rear;

a top layer covering said core layer, said top layer being softer than said core layer, and thicker toward the front and rear edges, wherein said top layer of said cushion tapers downwardly toward said rear; and wherein said core layer has a radius of about 4 to about 8 inches.

11. A heel pad for reducing the likelihood of decubitus ulcers on a patient's heels when the patient is lying on a mattress, the heel pad comprising:

a cushion adapted to rest on the mattress beneath the calves of the patient;

wherein said cushion has a front, a rear, a top, a bottom and a pair of ends, said cushion including a core layer having an arched profile, wherein said core tapers downward toward said front and said rear;

a top layer covering said core layer, said top layer being softer than said core layer, and thicker toward the front and rear edges, wherein said top layer of said cushion tapers downwardly toward said rear; and wherein said top layer has a density of about 1.5 lbs. per cubic foot.

12. A heel pad for reducing the likelihood of decubitus ulcers on a patient's heels when the patient is lying on a mattress, the heel pad comprising:

a cushion adapted to rest on the mattress beneath the calves of the patient;

wherein said cushion has a front, a rear, a top, a bottom and a pair of ends, said cushion including a core layer having an arched profile, wherein said core tapers downward toward said front and said rear;

a top layer covering said core layer, said top layer being softer than said core layer, and thicker toward the front and rear edges, wherein said top layer of said cushion tapers downwardly toward said rear; and wherein said core layer has a density of about 3.5 lbs. per cubic foot.

13. A heel pad for reducing the likelihood of decubitus ulcers on a patient's heels when the patient is lying on a mattress, the heel pad comprising:

a cushion adapted to rest on the mattress beneath the calves of the patient;

wherein said cushion has a front, a rear, a top, a bottom and a pair of ends, said cushion including a core layer having an arched profile, wherein said core tapers downward toward said front and said rear;

a top layer covering said core layer, said top layer being softer than said core layer, and thicker toward the front and rear edges, wherein said top layer of said cushion tapers downwardly toward said rear; and wherein said cushion has a thickness of about 1 inch to about 4 inches.

14. The heel pad of claim 13, wherein said thickness of said cushion is about 2 inches to about 2.5 inches.

15. The heel pad of claim 14, wherein said cushion has a thickness of about 2.25 inches.

16. The heel pad of claim 13, wherein said top layer has a thickness of about one half of the thickness of the cushion.

17. The heel pad of claim 15, wherein said top layer has a thickness of about one inch.

18. A heel pad for reducing the likelihood of decubitus ulcers on a patient's heels when the patient is lying on a mattress, the heel pad comprising:

a cushion adapted to rest on the mattress beneath the calves of the patient;

wherein said cushion has a front, a rear, a top, a bottom and a pair of ends, said cushion including a core layer having an arched profile, wherein said core tapers downward toward said front and said rear;

a top layer covering said core layer, said top layer being softer than said core layer and thicker toward the front and rear edges; and a riser located below said cushion and adapted to raise at least a portion of said cushion relative to the mattress.

19. The heel pad of claim 18, wherein said cushion rounds downwardly an extent effective to avoid pressure against the patient that would reduce blood flow to the patient's calf and heel.

20. The heel pad of claim 19, wherein said cushion rounds downwardly at the front edge to define a clearance between the top surface of the cushion and the underside of the patient's knee.

21. The heel pad of claim 19, wherein said cushion rounds downwardly at a radius of at least about 1 inch.

22. The heel pad of claim 19, wherein said cushion rounds downwardly at a radius conforming to the radius defined by the patient's calf and at least one of the patient's knee and heel.

23. A method of reducing the likelihood of decubitus heel ulcers comprising:

providing a cushion having a front, a rear, a top and a bottom, where said cushion includes a core layer and an outer layer, where the outer layer is softer than the core layer and thicker toward the front and rear of the cushion;

inserting the cushion beneath the calves of the patient and cantilevering the heels of the patient over the end of the pad covering the pad with a fluid resistant cover having downwardly extending flaps and tucking said flaps in around a mattress to maintain the position of the cushion relative to the calves of the patient.

24. The method of claim 23 further comprising the step of tying said flaps to each other below the mattress.

* * * * *